US005601375A

United States Patent [19]

Sims et al.

[11] Patent Number: 5,601,375

[45] Date of Patent: *Feb. 11, 1997

[54] AUTOMATIC TAPE DETECTING AND TAPE WIDTH IDENTIFYING PRINTING APPARATUS AND TAPE HOLDER

[75] Inventors: Charles R. Sims, Fowlmere; Michael A. Beadman, Steeple Morden; Andrew R. B. Halket, Cambridge, all of United Kingdom

[73] Assignee: Esselte N.V., St. Niklaas, Belgium

[ * ] Notice: The term of this patent shall not extend beyond the expiration date of Pat. No. 5,456,545.

[21] Appl. No.: 443,220

[22] Filed: May 17, 1995

Related U.S. Application Data

[63] Continuation of Ser. No. 71,122, Jun. 2, 1993, Pat. No. 5,456,545.

[30] Foreign Application Priority Data

May 6, 1992 [GB] United Kingdom ..... 9212004

[51] Int. Cl.[6] ..... B41J 29/18

[52] U.S. Cl. ..... 400/708; 400/207

[58] Field of Search ..... 400/708, 711, 400/707, 249, 248, 247, 219, 703

[56] References Cited

U.S. PATENT DOCUMENTS

| | | | |
|---|---|---|---|
| 4,492,483 | 1/1985 | Guillaume | 400/208 |
| 4,531,851 | 7/1985 | Kondo et al. | 400/708 |
| 4,685,818 | 8/1987 | Kazarian et al. | 400/249 |
| 4,840,504 | 6/1989 | Chu et al. | 400/248 |
| 4,880,323 | 11/1989 | Hilliser et al. | 400/248 |
| 5,073,052 | 12/1991 | Daley et al. | 400/208 |
| 5,078,523 | 1/1992 | McGourty et al. | 400/207 |
| 5,110,229 | 5/1992 | Ide | 400/219 |
| 5,324,123 | 6/1994 | Hattori | 400/207 |

FOREIGN PATENT DOCUMENTS

| | | | |
|---|---|---|---|
| 57670/80 | 4/1980 | Australia . | |
| 26053/84 | 3/1984 | Australia . | |
| 27551/88 | 7/1990 | Australia . | |
| 0077218 | 4/1983 | European Pat. Off. | B41J 35/36 |

(List continued on next page.)

OTHER PUBLICATIONS

Knodt et al., "Document Size Sensing".

Xerox Disclosure Journal, vol. 15, No. 4, Sep./Oct. 1990, pp. 345–346.

Amarakoon et al., "Sensor Assemblies for use in Feeding–Clinched Computer Forms", Xerox Disclosure Journal, vol. 17, No. 3, May/Jun. 1992, p. 175.

*Primary Examiner*—Edgar S. Burr
*Assistant Examiner*—Anthony H. Nguyen
*Attorney, Agent, or Firm*—Pennie & Edmonds

[57] ABSTRACT

An automatic tape detecting and tape width identifying printing apparatus or tape holder wherein the printing apparatus and tape holder include an optical sensing arrangement having at least first and second optical sensing assemblies. The first and second optical sensing assemblies each, preferably, include a photo transistor and a light emitting diode. The photo transistor is located to receive and detect light from the light emitting diode. The first and second optical sensing assemblies are located to automatically detect the presence or absence of tape within the tape holder. In a preferred embodiment, the first optical sensing assembly is located to automatically discriminate the presence of a particular width, w2, of tape within the tape holder. In addition, the second optical sensing assembly is located to automatically discriminate the presence of a different width, w1, of tape within the tape holder. The presence or absence of tape, and, if present, the width of the tape are automatically detected and a signal indicating such is transmitted from the first and/or second optical sensing assemblies to a controller. The controller prevents operation of the print head in the absence of tape and, when present, controls the print head to print within the width of tape detected. Thus, the present invention automatically prevents damage to the print head or platen of the printing apparatus.

15 Claims, 4 Drawing Sheets

FOREIGN PATENT DOCUMENTS

| | | | |
|---|---|---|---|
| 0267890 | 5/1988 | European Pat. Off. | B41J 25/30 |
| 0497352A2 | 8/1992 | European Pat. Off. | B41J 3/407 |
| 0526078A2 | 2/1993 | European Pat. Off. | B41J 32/00 |
| 3346482 | 7/1984 | Germany | 400/207 |
| 5916458 | 1/1984 | Japan | 400/249 |
| 0121985 | 6/1986 | Japan | 400/207 |
| 3162987 | 7/1991 | Japan | 400/249 |
| 6106834 | 4/1994 | Japan | 400/249 |

AUTOMATIC TAPE DETECTING AND TAPE WIDTH IDENTIFYING PRINTING APPARATUS AND TAPE HOLDER

This is a continuation of application Ser. No. 08/071,122, filed Jun. 2, 1993, now U.S. Pat. No. 5,456,545.

TECHNICAL FIELD

The present invention relates to a printing apparatus and is particularly concerned with thermal printing apparatus which receives tape holding cases housing a tape to be printed.

BACKGROUND ART

Printing apparatus of the general type with which the present invention is concerned are known. They operate with a supply of tape arranged to receive an image and a means for transferring the image onto the tape. In one known device, there is a tape holding case which holds a supply of image receiving tape and a supply of an image transfer ribbon, the image receiving tape and the transfer ribbon being passed in overlap through a printing zone of the printing device. At the print zone, a thermal print head cooperates with a platen to transfer an image from the transfer ribbon to the tape. A printing device operating with a tape holding case of this type is described for example in EP-A-0267890 (Varitronics, Inc.). Other printing devices have been made in which letters are transferred to an image receiving tape by a dry lettering or dry film impression process. In all of these printing devices, the construction of the image receiving tape is substantially the same. That is, it comprises an upper layer for receiving an image which is secured to a releasable backing layer by a layer of adhesive.

The upper layer can either receive an image on its top surface, its lower surface being secured to the releasable backing layer by a layer of adhesive or alternatively the upper layer can be transparent and can receive an image on one of its faces printed as a mirror image so that it is viewed the correct way round through the other surface of the tape. In this case, a double sided adhesive layer can be secured to the upper layer, this double sided adhesive layer having a releasable backing layer. This latter arrangement is described for example in EP-A-0322918 (Brother Kogyo Kabushiki Kaisha).

With such printing devices, it is important to be able to determine when the tape holding case used with the device has exhausted its supply of image receiving tape so that a new tape holding case can be inserted into the device. If the printing device is run with no image receiving tape there is a danger that the print head or platen will be damaged by overheating. Damage to the platen can also result if an image is transferred to it by the print head operating with no image receiving tape.

Furthermore, it is desirable for printing apparatus of this type to be able to operate with image receiving tapes of different widths. For this, the apparatus should include a way of identifying the width of tape within the tape holding case automatically so that the user does not have to concern himself with setting the apparatus for different tape widths. There is a danger if the user is called upon to set the tape width that the tape width will be incorrectly set.

SUMMARY OF THE INVENTION

The present invention seeks to provide a printing apparatus in which these problems are both overcome.

According to the present invention there is provided a printing device comprising a zone for receiving tape for printing so that said tape passes along a predetermined path in the printing device; an optical sensing arrangement comprising first and second optical sensing assemblies each comprising a light emitter and a light receiver arranged to receive light emitted from the light emitter, the optical sensing arrangement being located so that when there is no tape in said predetermined path the light receivers of the first and second assemblies receive light from their respective light emitters and when there is tape present in the predetermined path it obstructs light from at least one of said light emitters so preventing it from reaching its light receiver; and a controller for receiving signals from said light receivers and for controlling operation of the printing device in response to said signals.

The tape for printing is Conveniently housed in a tape holding case. Tape holding cases for use with the printing device can be supplied holding tapes of respective differing widths. The tape holding cases have similar external dimensions for reception by said zone but are arranged to accommodate internally tapes of respective differing widths. In one embodiment of the present invention a tape holding case is provided with a tape guide arrangement comprising a plurality of sets of tape guides, each set fitting a particular tape width. Thus, only one type of tape holding case needs to be manufactured and can accommodate reels of tape of different widths as desired. The sets of guides are located to guide the tape in cooperation with the optical sensing assemblies. Where two tape holding cases are arranged to supply tape of different widths along said predetermined path with a common centre line the optical sensing arrangement can be such that the first optical sensing assembly is located below the second. With this arrangement, with a tape holding case holding a narrow tape it will obstruct light only in the second optical sensing assembly and not in the first. With a wide tape, however, both of the optical sensing assemblies will be affected. The controller thus receives signals informing it either that there is no tape (where neither of the light emitters is obstructed), or that there is narrow tape present (where only the second of the light emitters is obstructed) or that there is wide tape present (where both of the light emitters are obstructed).

More than two widths of tape can be taken into account by providing further optical sensing assemblies located suitably. If one particular arrangement, a tape holding case can be arranged to accommodate tape narrower than the narrow width tape already mentioned. Where this tape is centered about the centre line the optical sensing arrangement requires a third optical sensing assembly located above the second assembly so that only the third optical assembly is affected by the tape when present. In another arrangement, the narrower tape is located in a tape holding case so that its lower edge corresponds to the lower edge of the widest tape so that it obstructs only the first light emitter and not the second light emitter. Thus, a different combination of signals is then supplied to the controller to indicate that there is this narrow tape, namely that only the first light emitter is obstructed.

The invention also contemplates the combination of a printing device and a cooperable tape holding case. A tape holding case can be provided with a housing which accommodates the tape and which has an aperture for receiving the optical sensing arrangement.

Typical tape widths are 19 mm, 12 mm and 6 mm although it will readily be appreciated that different tape widths can be used with the present invention.

It will be appreciated that in practice tape holding cases will be manufactured holding a single reel of tape of a predetermined width. When this is inserted into the device the device is immediately informed through the controller of the width of tape which is present and can thus set itself to appropriate label composition parameters. Thus, a user is not required to input into the machine what tape width is being used.

Moreover, when the tape in a tape holding case runs out the device will be advised through the controller and operation will be inhibited to prevent damage to the print head and platen.

BRIEF DESCRIPTION OF THE DRAWINGS

For a better understanding of the present invention and to show how the same may be carried into effect reference will now be made by way of example to the accompanying drawings in which:

FIG. 3(*a*) is a side view of another embodiment of the optical sensing device.

DETAILED DESCRIPTION OF THE INVENTION

Figure 1:
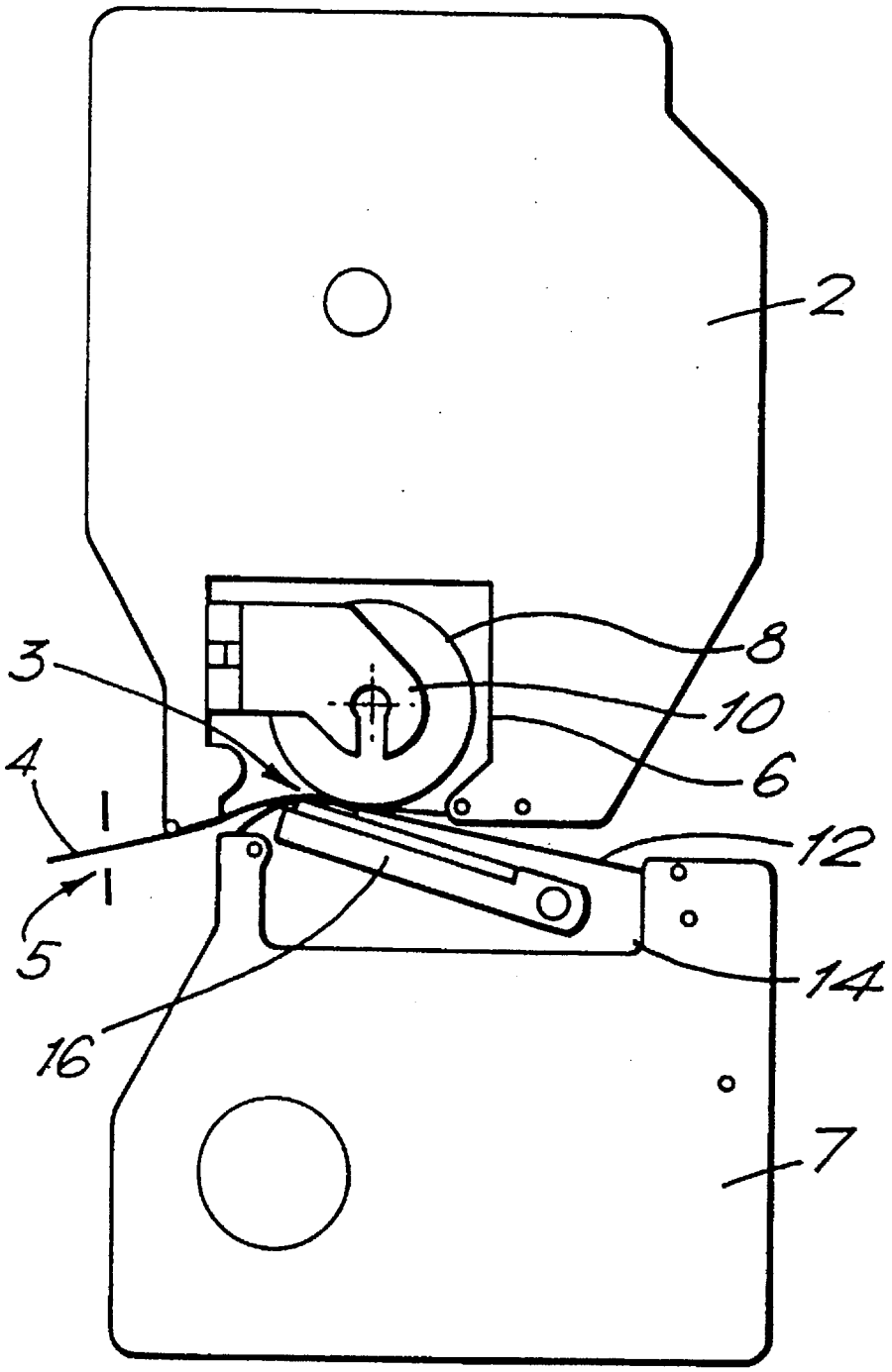
FIG. 1 is a plan view showing two cassettes inserted into a printing device.

FIG. 1 shows in plan view two cassettes arranged in a printing device. The upper cassette 2 contains a supply of image receiving tape which passes through a print zone 3 of the printer to an outlet 5 of the printer. The image receiving tape 4 comprises an upper layer for receiving a printed image on one of its surfaces and having its other surface coated with an adhesive layer to which is secured a releasable backing layer. The cassette 2 has a recess 6 for accommodating a platen 8 of the printer. The platen 8 is mounted for rotation within a cage moulding 10.

The lower cassette 7 contains a thermal transfer ribbon which extends from a supply spool to a take-up spool within the cassette 7. The thermal transfer ribbon 12 extends through the print zone 3 in overlap with the image receiving tape 4. The cassette 7 has a recess 14 for receiving a print head 16 of the printer. The print head 16 is movable between an operative position, shown in FIG. 1, in which it is in contact with the platen and holds the thermal transfer ribbon 12 and the image receiving tape 4 in overlap between the print head and the platen and an inoperative position in which it is moved away from the platen to release the thermal transfer ribbon and image receiving tape. In the operative position, the platen is rotated to cause image receiving tape to be driven past the print head and the print head is controlled to print an image onto the image receiving tape by thermal transfer of ink from the ribbon 12. The print head is a conventional thermal print head having an array of pixels each of which can be thermally activated in accordance with the desired image to be printed.

Figure 2:
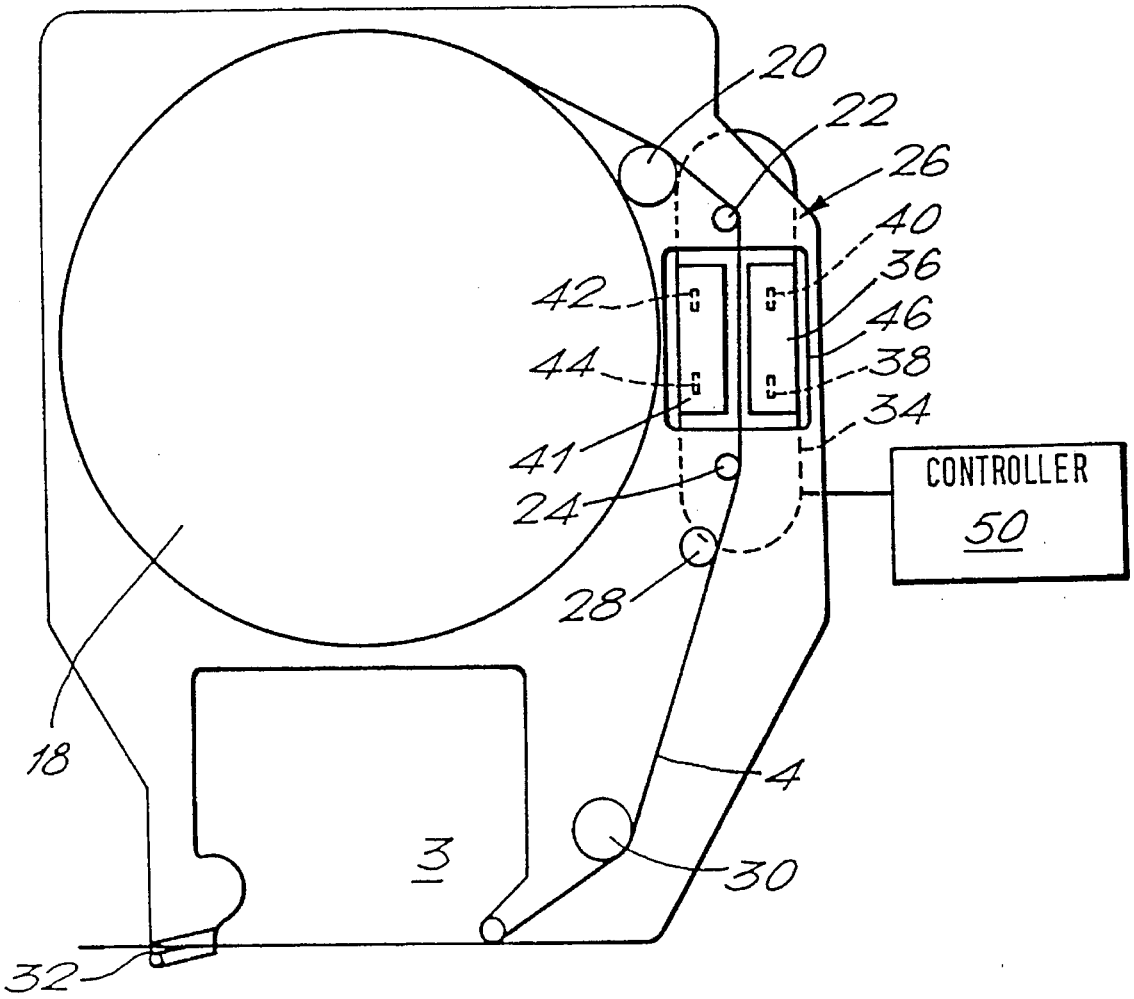
FIG. 2 is a plan view showing the upper cassette and the optical sensing arrangement in more detail.

FIG. 2 shows a plan view of the cassette 2 with the cover of the cassette housing having been removed. The supply of image receiving tape 4 takes the form of a reel 18 from which is fed along a tape path defined by a plurality of guide pins or guide rollers. A first guide pin 20 is located as the tape 4 leaves the reel 18. Second and third guide pins 22,24 are located within the cassette housing to guide tape 4 through an optical sensing assembly 26 to be described in more detail hereinafter. A fourth guide pin 28 guides the tape 4 past an outlet of the optical sensing assembly 26 and a fifth guide pin 30 guides the tape 4 through the print zone 3 and thence to an outlet 32 of the cassette.

The optical sensing arrangement 26 comprises a housing 34 mounted on the printing device and containing a first support 41 which carries two light emitting diodes 42,44. Arranged opposite the first support 41 is a second support 36 which carries two photo transistors 38,40 located to receive light from the light emitting diodes 44 and 42 respectively.

Figure 3:
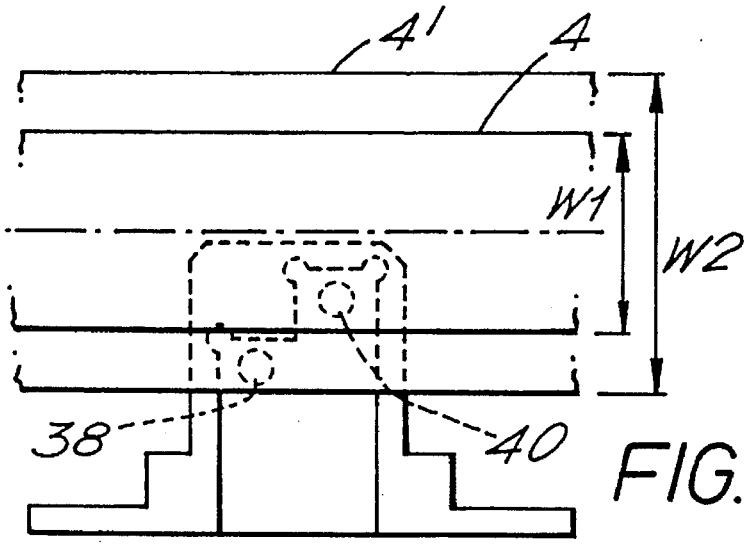
FIG. 3 is a side view of one embodiment of the optical sensing device.
Figure 3A:
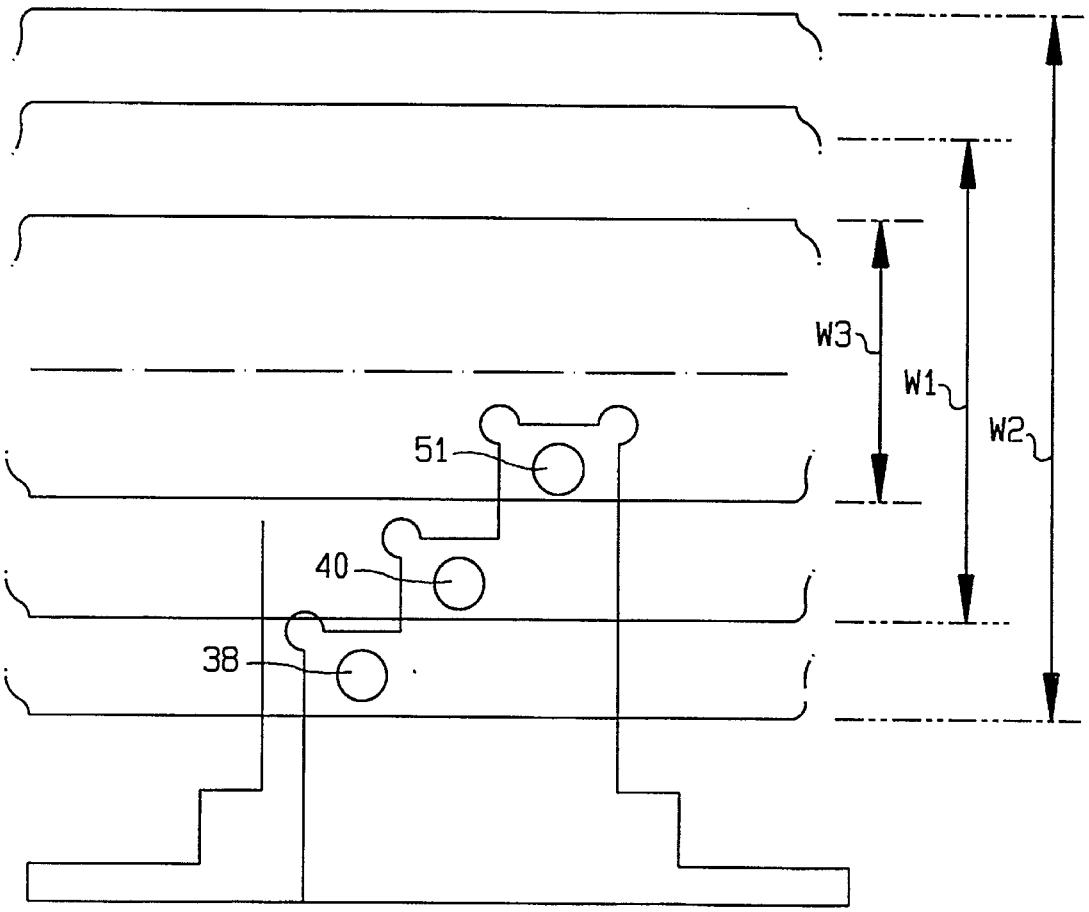

Each light emitting diode and photo transmitter constitute an optical sensing assembly. As shown in FIG. 3 one optical assembly 38,44 is arranged vertically below the other optical assembly 40,42. FIG. 3A illustrates the use of a third photo transmitter 51.

The cassette housing has an aperture 46 for receiving the supports 36 and 41 when the cassette is inserted into the printing device. The tape path in the cassette is such that when the cassette is loaded into the printing device the tape passes between the light emitting diodes and their respective photo transistors with the image receiving surface disposed vertically (i.e. perpendicular to the floor of the printing device).

As shown most clearly in FIG. 3, the optical assemblies 38,44 and 40,42 are spaced apart vertically to allow for the sensing of tapes of different widths. In FIG. 3, the centre line of tape is denoted by a dot-dash line and FIG. 3 thus illustrates tape 4,4' of two different tape widths, w1 which is typically 12 mm and w2 which is typically 19 mm.

Signals from the photo transistors 38,40 are fed from the optical sensing arrangement 26 to a controller 50 for controlling the printing device.

With no tape present in the path between the guide pins 22 and 24 through the optical sensing arrangement 26 light from each photo diode 42,44 is sensed by its respective photo transistor 38,40 which provide respective "0" signals to the controller 50 to indicate that there is no tape present. If a cassette holding tape 4 of the narrower width w1 is inserted, light from the upper of the two diodes 42 is prevented from reaching its corresponding photo transistor 40 while light from the lower diode 44 is unobstructed. This then provides respective "0" and "1" signals to the controller to indicate that narrow tape is present. If a cassette holding tape 4' of the wider width w2 is inserted, not only is light from the upper diode 42 obstructed but also light from the lower diode 44. This provides respective "1","1" signals to the controller to indicate that wide tape is present.

When a cassette is inserted therefore the controller is notified automatically what width of tape is present and sets its criteria accordingly for the composition of labels. In use off the device when the tape runs out the signals identifying "no tape present" are passed to the controller 50 to indicate that the device should cease to operate and the cassette requires replacement. In the preferred arrangement, this signal automatically inhibits further operation of the device, with the possibility of allowing the device to continue to operate for a short time to take into account the path length of tape from the optical sensing arrangement 26 through the print zone and through the outlet of the cassette 32. The controller can inhibit further operation of the device by preventing further rotation of the plates and/or terminating print signals to the print head. A light can be illuminated on the device to indicate no tape present.

Thus, the described arrangement provides a simple sensing assembly which not only indicates when tape has run out but also enables the device to be aware of the width of tape which is being used.

It will readily be appreciated that the described arrangement can be modified to take into account more than two different widths of tape. For example, to accommodate a further width w3, narrower than w1 and typically 6 mm could be done in one of two ways. This tape could be positioned about the centre line and a third diode could be provided above the diode 42 to discriminate for this size as shown in FIG. 3(*a*). As an alternative, the narrow tape could be positioned with its lower edge corresponding to the lower edge of the wide tape of width w2 so that it affects only the lower of the two sensing assemblies 38,44 and not, the upper sensing assemblies 40,42. The controller 50 would then be required to discriminate as to which photo transistors had been obstructed. A table showing the logic arrangement is set out below where 0 indicates unobstructed photo transistors and 1 indicates obstructed photo transistors.

| | | | | | |
|---|---|---|---|---|---|
| Top | (40,42) | 1 | 0 | 1 | 0 |
| Bottom | (38,44) | 0 | 1 | 1 | 0 |
| | | 12 mm | 6 mm | 19 mm | Tape out |

Figure 4:
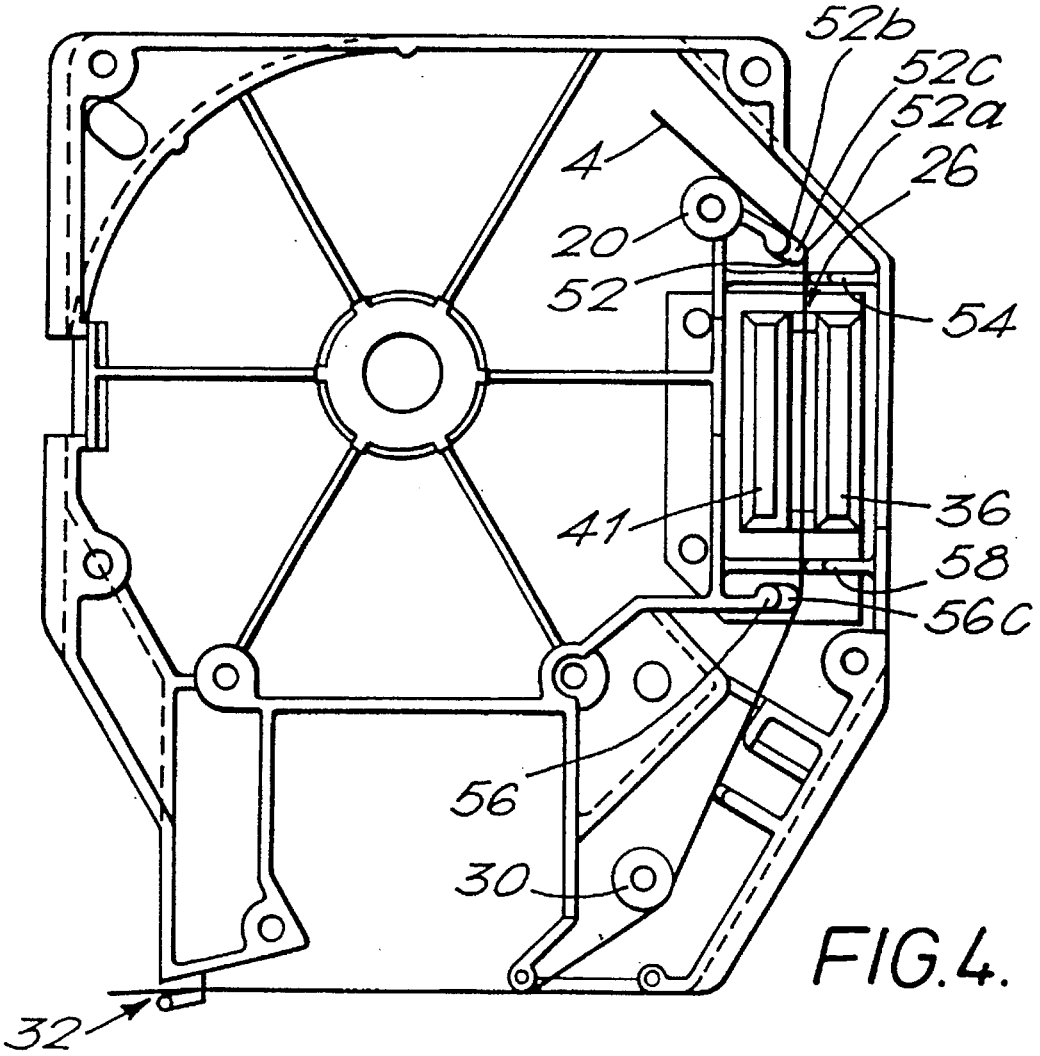
FIG. 4 is a plan view of the lower half of a cassette showing the tape guides.

Reference is now made to FIG. 4 which illustrates in plan view the lower part of the cassette. Reference numerals in FIG. 4 indicate like parts as in FIG. 3 but FIG. 4 shows in addition a modified guiding arrangement to replace the guide pins designated by reference numerals 22 and 24 in FIG. 2.

There is a plurality of guide elements designated by reference numerals 52,54 (for guiding the tape as it enters the optical assembly 26) and 56,58 (for guiding the tape as it leaves the optical assembly 26). Each guide element is constructed t0 have a vertical surface for guiding tape of a wide width and a vertical surface for guiding tape of a narrower width, the construction of the guide element being such that the tape of narrower width is automatically located against its guide surface. Taking the guide element 52 as an example, there is a guide surface 52*a* for guiding the tape 4 of wide width and a guide surface 52*b* for guiding tape of a narrower width. The guide element has a horizontal surface 52*c* for locating tape of a narrower width against the guide surface 52*b*. Each of the guide elements 52,54,56,58 are similarly constructed. In this way, a common tape holding case can be manufactured to receive reels of different width tapes according to choice. It will be apparent that the guide elements can be modified so as to receive tapes of more than two widths.

Each tape guide element extends from a base of the tape holding case in a direction widthwise of the tape 4 and comprises two lateral tape guide surfaces 52*a*, 52*b* spaced apart in the direction of the tape width.

The base provides a support for a longitudinal edge of tape of a first width such that the centre line of said tape is located along a line spaced from the base. The tape guide elements provide respective support surfaces 52*c*, 56*c* for the longitudinal edge of tape of a second width whereby its centre line lies along the centre line of tape of said first width.

A top part is used to construct the tape holding case, the top fitting onto the lower part of the tape holding case to provide a secure unit. The tape holding case then has the same external dimensions whether it is holding tape of the first, second or third width. The optical sensing arrangement enables the width of tape to be ascertained.

What is claimed is:

1. A tape printing device comprising:

a zone for receiving tape for printing having a predetermined path for the passage of said tape wherein, on reception, said tape passes along said predetermined path;

an optical sensing arrangement comprising first and second optical sensing assemblies each comprising a light emitter, a light receiver, and a sensing path between said light emitter and said light receiver, said light receiver being arranged to receive light emitted from the light emitter when the sensing path is not obstructed, said first light sensing assembly being arranged in a first sensing position wherein tape of a first width present in said predetermined path obstructs said sensing path of said first sensing assembly, and said second sensing assembly being arranged in a second sensing position wherein tape of a second width present in said predetermined path obstructs said sensing path of said second sensing assembly;

a controller for receiving signals from said light receivers and for controlling operation of the printing device in response to said signals, said signals representing a first state in which tape of a first width is present, a second state in which tape of a second width is present, and a third state in which no tape is present; and means for receiving a tape holding case which houses tape of one of said first and second widths and providing tape positioned between said light emitter and said light receivers.

2. A printing device according to claim 1, wherein the first optical sensing assembly is located below the second optical sensing assembly in a direction of tape width, tape of said first width obstructing said sensing paths of both said first and second sensing assemblies, and tape of said second width obstructing said sensing path of only said second sensing assembly.

3. A printing device according to claim 1, wherein the controller is operable to inhibit operation of the printing device in response to signals from said light receivers indicating said third state.

4. A printing device according to claim 1, which comprises a third optical sensing assembly, said first, second, and third optical sensing assemblies being located one below another in the direction of tape width in a manner such as to discriminate between tapes of at least three different widths.

5. A printing device according to claim 1, in combination with a tape holding case housing a supply of tape.

6. A printing device according to claim 5, wherein the second optical sensing assembly is located closer to a center line of tape than the first optical assembly wherein when the tape holding case holds tape of said second width centered about said center line, said sensing path of the second optical sensing assembly is obstructed but not said sensing path of the first optical sensing assembly and when the tape holding case holds tape of said first width, wider than said second width, said sensing path of both the first and second optical sensing assemblies is obstructed, thereby enabling the controller to discriminate between tapes of the first and second widths.

7. A printing device according to claim 6, wherein a third optical sensing assembly is provided closer to said center line of tape than said second optical sensing assembly, thereby enabling the controller to discriminate between tapes of first, second and third widths, wherein said third width is narrower than said second width whereby light only in said third optical sensing assembly is obstructed.

8. A printing device according to claim 6, in combination with a tape holding case in which tape of a third width narrower than said first width is guided with its lower edge corresponding to a lower edge position of tape of said first width, whereby it obstructs light only in said first optical assembly and not in said second optical assembly.

9. An apparatus comprising:

a tape holding case which houses tape of one of first and second widths, in combination with a tape printing device comprising:

a zone, for receiving tape for printing, having a predetermined path for passage of said tape wherein, on reception, said tape passes along said predetermined path;

an optical sensing arrangement comprising first and second optical sensing assemblies each comprising a light emitter, a light receiver, and a sensing path between said light emitter and said light receiver, said light receiver being arranged to receive light emitted from the light emitter when the sensing path is not obstructed, said first light sensing assembly being arranged in a first sensing position wherein tape of a first width present in said predetermined path obstructs said sensing path of said first sensing assembly, and said second sensing assembly being arranged in a second sensing position wherein tape of a second width present in said predetermined path obstructs said sensing path of said second sensing assembly; and a controller for receiving signals from said light receivers and for controlling operation of the printing device in response to said signals, said signals representing a first state in which tape of a first width is present, a second state in which tape of a second width is present, and a third state in which no tape is present;

said tape printing device including means for receiving said tape holding case with the tape positioned between said light emitters and said light receivers.

10. A tape holding case for use in a printing device comprising a housing wherein said housing is provided with external dimensions to suit said printing device and is arranged to accommodate internally any one of a plurality of tapes of respective different widths; and an internal tape guide arrangement comprising a plurality of sets of tape guides, each tape guide comprising a member extending from a base of the tape holding case in a direction widthwise of the tape, said member comprising a plurality of lateral tape guide surfaces spaced apart in the direction of the tape width, wherein each of said sets of tape guides are configured to position any one of said plurality of tapes by maintaining the center line of each tape at a constant elevation regardless of the width of the tape.

11. A tape holding case according to claim 10, which comprises a base which provides a support for a longitudinal edge of tape of a first width such that the center line of said tape is located along a line spaced from the base and wherein said tape guide members provide respective support surfaces for the longitudinal edge of tape of a second width whereby its center line lies along the center line of tape of said first width.

12. A tape holding case for use in a printing device comprising a housing having its external dimensions adapted to suit said printing device and arranged to accommodate internally any one of a plurality of tapes of respective different widths, which comprises an internal tape guide arrangement comprising a plurality of sets of tape guides, each tape guide comprising a member extending from a base of the tape holding case in a direction widthwise of the tape and comprising a plurality of lateral tape guide surfaces spaced apart in the direction of the tape width, each of said sets of tape guides being configured for positioning any one of said plurality of tapes by maintaining the center line of each tape at a constant elevation regardless of the width of the tape.

13. A tape holding case according to claim 12, which comprises a base which provides a support for a longitudinal edge of tape of a first width such that the center line of said tape is located along a line spaced from the base and wherein said tape guide members provide respective support surfaces for the longitudinal edge of tape of a second width whereby its center line lies along the center line of tape of said first width.

14. A tape printing device comprising:

a zone, for receiving image receiving tape for printing thereon, said zone having a predetermined path for the passage of said image receiving tape wherein, on reception, said image receiving tape passes along said predetermined path;

an optical sensing arrangement comprising first and second optical sensing assemblies each of said first and said second optical sensing assemblies comprising a light emitter, a light receiver, and a sensing path between said light emitter and said light receiver, said light receiver being arranged to receive light emitted from said light emitter when said sensing path is not obstructed, said first light sensing assembly being arranged in a first sensing position wherein tape of a first width present in said predetermined path obstructs said sensing path of said first sensing assembly, and said second sensing assembly being arranged in a second sensing position wherein tape of a second width present in said predetermined path obstructs said sensing path of said second sensing assembly;

a controller for receiving signals from said light receivers of said first and second light sensing assemblies and for controlling operation of said printing device in response to said signals, said signals representing a first state corresponding to said image receiving tape having said first width being present in said predetermined path, a second state corresponding to said image receiving tape having said second width being present in said predetermined path, and a third state corresponding to said image receiving tape being absent from said predetermined path; and a means for accepting an image receiving tape holding case which houses said image receiving tape of one of said first and said second widths and providing said image receiving tape positioned between said light emitters and said light receivers of said first and said second light sensing assemblies.

15. A tape printing device comprising:

a zone, for receiving image receiving tape for printing thereon, said zone having a predetermined path for the passage of said image receiving tape wherein, on reception, said image receiving tape passes along said predetermined path;

an optical sensing arrangement comprising first and second optical sensing assemblies, each of said first and said second optical sensing assemblies comprising a light emitter, a light receiver, and a sensing path between said light emitter and said light receiver, said light receiver being arranged to receive light emitted from said light emitter when said sensing path is not obstructed, said first light sensing assembly being arranged in a first sensing position wherein tape of a first width present in said predetermined path obstructs said sensing path of said first sensing assembly, said second sensing assembly being arranged in a second sensing position wherein tape of a second width present in said predetermined path obstructs said sensing path of said second sensing assembly, and said first sensing position being located below said second sensing position in a direction of said width of said image receiving tape;

a controller for receiving signals from said light receivers of said first and second light sensing assemblies and for controlling operation of said printing device in response to said signals, said signals representing a first state corresponding to said image receiving tape having said first width being present in said predetermined path, a second state corresponding to said image receiving tape having said second width being present in said predetermined path, and a third state corresponding to said image receiving tape being absent from said predetermined path; and a means for accepting an image receiving tape holding case which houses said image receiving tape of one of said first and said second widths and providing said image receiving tape positioned between said light emitters and said light receivers of said first and said second light sensing assemblies.

* * * * *